US011425488B2

(12) United States Patent
Park et al.

(10) Patent No.: US 11,425,488 B2
(45) Date of Patent: Aug. 23, 2022

(54) DUCT STRUCTURE OF EARPHONE SPEAKER UNIT

(71) Applicant: BUJEON CO., LTD., Ansan-si (KR)

(72) Inventors: Minkoo Park, Hwaseong-si (KR); Seungcheol Lee, Ansan-si (KR)

(73) Assignee: BUJEON CO., LTD., Ansan-si (KR)

( * ) Notice: Subject to any disclaimer, the term of this patent is extended or adjusted under 35 U.S.C. 154(b) by 0 days.

(21) Appl. No.: 17/236,218

(22) Filed: Apr. 21, 2021

(65) Prior Publication Data

US 2021/0352398 A1 Nov. 11, 2021

(30) Foreign Application Priority Data

May 7, 2020 (KR) ..... 10-2020-0054588

(51) Int. Cl.
*H04R 1/28* (2006.01)
*H04R 1/10* (2006.01)

(52) U.S. Cl.
CPC ..... *H04R 1/2823* (2013.01); *H04R 1/10* (2013.01); *H04R 1/2811* (2013.01)

(58) Field of Classification Search
CPC ..... H04R 1/2823; H04R 1/10; H04R 1/2811; H04R 1/12; H04R 1/22; H04R 1/1008; H04R 1/1016; H04R 1/1066; H04R 1/1058; H04R 1/1075; H04R 1/2826; H04R 1/2846; H04R 1/2849; H04R 31/006; H04R 7/16; H04R 5/033; H04R 5/0335; H04R 25/652; H04R 2201/107; H04R 2420/07; A63J 17/00
USPC ..... 381/150, 370, 371, 380
See application file for complete search history.

(56) References Cited

U.S. PATENT DOCUMENTS

| | | | | |
|---|---|---|---|---|
| 11,026,012 | B1 * | 6/2021 | Ko | H04R 1/2803 |
| 2016/0219360 | A1 * | 7/2016 | Zhao | H04R 1/2823 |
| 2017/0006373 | A1 * | 1/2017 | Bruss | H04R 1/2826 |
| 2018/0310090 | A1 * | 10/2018 | Wen | H04R 5/033 |
| 2021/0021921 | A1 * | 1/2021 | Min | H04R 1/1016 |
| 2021/0099784 | A1 * | 4/2021 | Lin | H04R 1/2811 |

(Continued)

FOREIGN PATENT DOCUMENTS

| | | | | |
|---|---|---|---|---|
| CN | 208522932 U | * | 2/2019 | H04R 1/10 |
| CN | 209170614 U | * | 7/2019 | H04R 1/10 |

(Continued)

*Primary Examiner* — Ahmad F. Matar
*Assistant Examiner* — Sabrina Diaz
(74) *Attorney, Agent, or Firm* — KORUS Patent, LLC; Seong Il Jeong

(57) ABSTRACT

The present invention provides a duct structure of an earphone speaker unit comprising: a diaphragm; a speaker module located at a back of the diaphragm, comprising an acoustic coil, a magnet, and a yoke, and generating sound of the diaphragm, and a frame member surrounding the yoke, wherein the frame member forms a donut-shaped duct space along circumference of the yoke, and wherein the frame member comprises: an inflow hole formed to enable sound generated from the speaker module to flow into the duct space; an outflow hole formed to enable sound inside the duct space to flow out to the outside; a partition wall blocking a path of sound in a vertical direction inside the duct space; a tuning hole formed to penetrate through the partition wall; and a mesh member installed to block the tuning hole, thereby enabling acoustic tuning.

6 Claims, 13 Drawing Sheets

(56) References Cited

U.S. PATENT DOCUMENTS

| | | | | |
|---|---|---|---|---|
| 2021/0136484 | A1* | 5/2021 | Ji | H04R 1/2826 |
| 2021/0243530 | A1* | 8/2021 | Ko | H04R 9/046 |
| 2021/0289279 | A1* | 9/2021 | Ko | H04R 1/1016 |

FOREIGN PATENT DOCUMENTS

| | | | |
|---|---|---|---|
| KR | 10-1956884 | B1 | 3/2019 |
| KR | 10-2059001 | B1 | 12/2019 |
| KR | 10-2020-0022709 | A | 3/2020 |

* cited by examiner

DUCT STRUCTURE OF EARPHONE SPEAKER UNIT

FIELD OF THE INVENTION

The present invention relates to a duct structure of an earphone speaker unit and more particularly, to a duct structure of an earphone speaker unit having a duct space easing tuning and minimizing sound deviation caused by assembly.

BACKGROUND OF THE INVENTION

In general, an earphone is a type of device converting an electrical energy to an acoustic energy and refers to a small-sized speaker inserted into both ears of a user to reduce ambient noise.

A speaker unit, which is a key component of an earphone, comprises a diaphragm, an acoustic coil, a magnet, and a frame packaging the foresaid elements. The speaker generates sound through interaction among the elements. A front portion of the diaphragm emits generated sound through a hole of the earphone to transfer the sound into ears of a user, and sound generated toward an opposite direction of the diaphragm is emitted to the outside through a duct structure of a frame.

Sound emitted to the opposite direction of the diaphragm is controlled by a duct structure of a frame. Since acoustic tuning is different depending on the duct structure, a frame structure is needed to be designed for efficient acoustic tuning.

A related prior art, Korean Registration Patent No. 10-2059001, discloses a portable sound device comprises: a housing including a sound hole formed in one side; a sound output part; a inner microphone collecting sound through the sound hole; and a controller mounted inside the housing, outputting sound by controlling the sound output part, and processing the collected sound, wherein the sound output part comprises a frame; a diaphragm located in one side of the frame; an acoustic coil located inside the frame; a permanent magnet forming a magnetic field around the acoustic coil; a signal cord connecting the acoustic coil and the controller; a ventilation hole communicating between the inside of the frame and the outside; and a mesh covering the ventilation hole.

The prior art discloses a structure where sound is emitted through the ventilation hole formed in a center of the frame. In addition, the mesh covering the ventilation hole is designed for reducing ambient sound purpose, not for acoustic tuning purpose. Furthermore, there is no element related to a duct structure for acoustic tuning.

TECHNICAL PROBLEM

The present invention is devised to solve the problems mentioned above. One object of the invention is to provide a duct structure of an earphone speaker unit configured to integrate a space necessary for acoustic tuning and a duct space with a frame connected to a back of a diaphragm, thereby providing a duct structure optimized for acoustic tuning within design range limit and minimizing sound deviation caused by assembly.

SUMMARY OF THE INVENTION

The present invention provides a hair dyeing apparatus comprising a 1. A duct structure of an earphone speaker unit, the duct structure comprising: a diaphragm; a speaker module located at a back of the diaphragm, comprising an acoustic coil, a magnet, and a yoke, and generating sound of the diaphragm, and a frame member surrounding the yoke of the speaker module, wherein the frame member forms a donut-shaped duct space along circumference of the yoke, and wherein the frame member comprises: an inflow hole formed in an outer surface thereof to enable sound generated from the speaker module to flow into the duct space of the frame member; an outflow hole formed in an outer surface thereof to enable sound inside the duct space to flow out to the outside; a partition wall blocking a path of sound in a vertical direction inside the duct space; a tuning hole formed to penetrate through the partition wall; and a mesh member installed to block the tuning hole, thereby enabling acoustic tuning.

The inflow hole and the outflow hole are located in opposite sides of the partition wall, respectively, and wherein a duct path from the inflow hole to the outflow hole is formed to have 90 degrees or more with regard to a horizontal plane.

The partition wall comprises: a lower vertical wall vertically formed from a bottom of the duct space to a level of a given height; an upper vertical wall vertically formed from a top of the duct space to the level of the height of the lower vertical wall at a location distant from the lower vertical wall; and a connection wall horizontally connecting between the lower vertical wall and the upper vertical wall, wherein the tuning hole is formed in the connection wall, thereby enabling the mesh member to be formed in a horizontal direction.

The frame member comprises: a lower frame surrounding circumference of the yoke at a location close to the diaphragm and including the inflow hole formed to communicate in a vertically direction; and an upper frame that is connected to a top portion of the lower frame, thereby forming the duct space and that includes the outflow hole formed at a top portion thereof and the partition wall integrated thereto.

The duct structure comprising: a diaphragm; a speaker module located at a back of the diaphragm, comprising an acoustic coil, a magnet, and a yoke, and generating sound of the diaphragm, and a frame member surrounding the yoke of the speaker module, wherein the frame member forms: a first duct space having a donut shape along circumference of the yoke, and a second duct space having a circle shape and formed from a top of the partition wall to a level spaced apart from the yoke; wherein the frame member comprises: an inflow hole formed in a top portion of the yoke to enable sound generated from the speaker module to flow into the second duct space; a connection hole communicating between the second duct space and the first duct space; an outflow hole formed in one side of the first duct space to enable sound inside the first duct space to flow out to the outside; a tuning hole formed in the second duct space and communicating to the outside; and a mesh member installed to block the tuning hole, thereby enabling acoustic tuning.

The outflow hole and the tuning hole are formed in a same direction with regard to a center of the duct structure as seen from a top view, and the tuning hole is located above the outflow hole, wherein the connection hole is formed at a location in an opposite direction to the direction of the outflow hole and the tuning hole with regard to a center of the duct structure as seen from a top view.

The frame member comprises: a first frame surrounding circumference of the yoke; a second frame connected to a top portion of the first frame, forming a first duct space along circumference of the yoke with a L-shape cross-section thereof, and including the outflow hole formed in an edge portion thereof and the connection hole formed in a top portion thereof; and a third frame that is connected to a top portion of the second frame; that forms a second duct space that is formed to a level spaced apart from a top of the yoke and that is larger than the first duct space; and that includes the outflow hole formed in a top portion thereof.

TECHNICAL EFFECTS OF THE INVENTION

According to the present invention, a duct structure of an earphone speaker unit can provide a duct structure optimized for acoustic tuning within design range limit and can minimize sound deviation caused by assembly.

In addition, a duct structure of an earphone speaker unit can improve sound quality of the earphone by enabling efficient tuning of middle frequency range sounds and improving resonance and sound pressure properties of low frequency range sounds.

DETAILED DESCRIPTION EMBODIMENTS OF THE INVENTIONS

Figure 1:
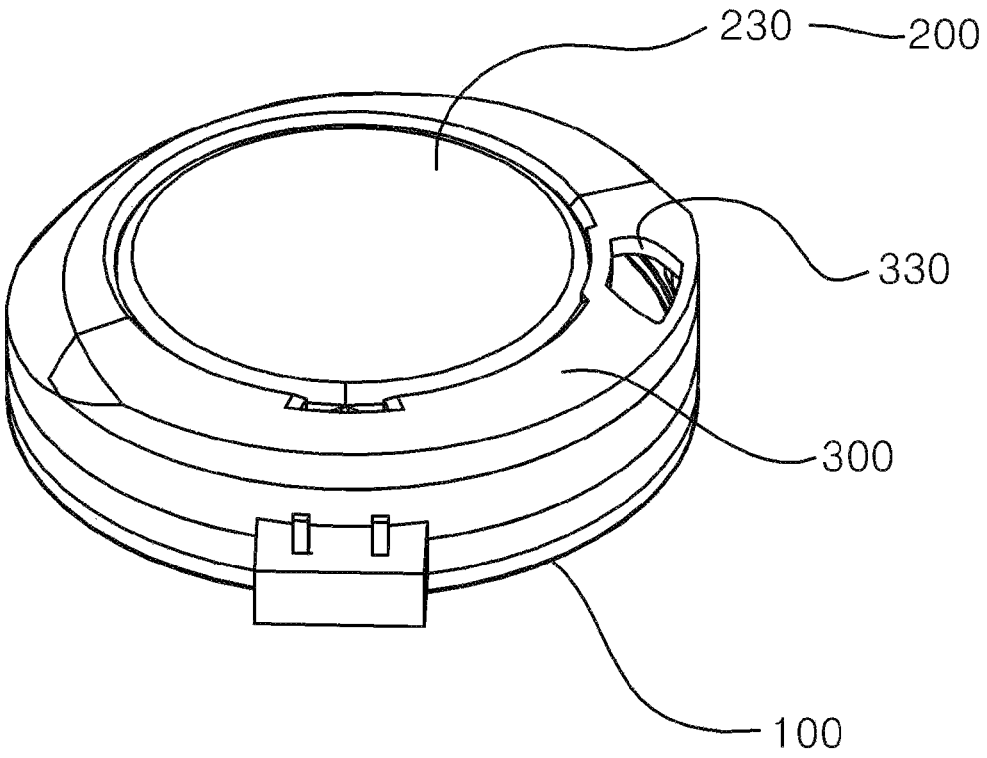
FIG. 1 is a perspective view showing a first embodiment of a duct structure of an earphone speaker unit according to the present invention.

Hereafter, the present invention will be described in more detail with reference to accompanying drawings. In addition, detailed explanation regarding related elements or functions, which are well known to one of ordinary skill in the art, are omitted in case it may cloud the gist of the present invention.

A duct structure of an earphone speaker unit according to the present invention comprises a diaphragm 100; a speaker module 200 connected to a back of the diaphragm 100, including an acoustic coil 210, a magnet 220, and a yoke 230, and generating sound of the diaphragm 100; and a frame member 300 surrounding the yoke 230 of the speaker module 200, and is characterized by a duct structure formed by the frame member 300.

In this instance, the elements of the diaphragm 100, the acoustic coil 210, the magnet 220, and the yoke 230 are not significantly different from related art, which are well known to one of ordinary skill in the art. Accordingly, detailed explanation regarding the foresaid elements will be omitted.

The present invention may comprise a first embodiment and a second embodiment, which can be distinguished according to a form of the frame member 300 and a connection type to the yoke 230.

First Embodiment

Figure 2:
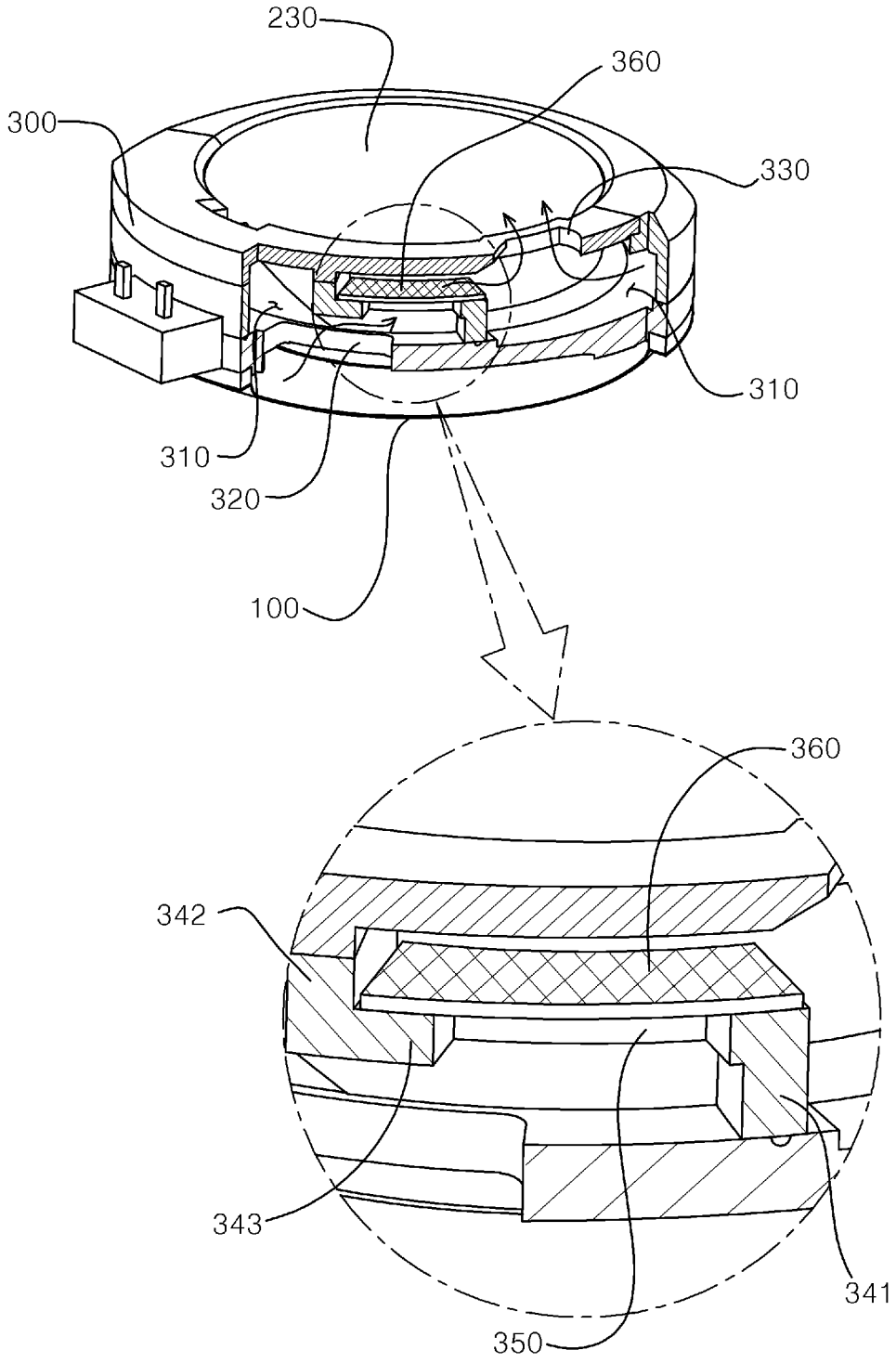
FIG. 2 is a perspective view with a partial cross-section of an inner structure of a frame member in the first embodiment of the present invention.

As illustrated in FIGS. 1 and 2, the frame member 300 according to the first embodiment of the present invention forms a donut-shaped duct space 310 along circumference of the yoke 230, and comprises an inflow hole 320 formed to enable sound generated from the speaker module 200 to flow into a duct space 310 of the frame member 300; an outflow hole 330 formed to enable sound inside the duct space 310 to flow out to the outside; a partition wall 340 blocking a path of sound in a vertical direction of the duct space 310; a tuning hole 350 formed to penetrate through the partition wall 340; and a mesh member 360 installed to block the tuning hole 350, thereby enabling acoustic tuning.

The duct space 310 of the first embodiment is formed to have a donut shape along circumference of the yoke 230, and induces sound (air) to flow therein or flow out therefrom through the inflow hole 320 and the outflow hole 330. The duct space 310 allows other elements to be formed therein as well as sound inflow and outflow. The partition wall 340 is formed in the duct space 310, and a tuning hole 350 and a mesh member 360 are formed in the partition wall 340 for acoustic tuning of middle frequency range sound.

The inflow hole 320 is a hole formed in the frame member 300 in order to flow sound (air) inside the diaphragm 100 into the duct space 310. The inflow hole 320 may be formed in a single portion, or in a plurality of portions as illustrated in drawings.

The outflow hole 330 is a hole through which sound transferred to the duct space 310 through the inflow hole 320 flows out to the outside. Both sound, which passes through the tuning hole 350 and the mesh member 360 and sound, which does not, flow out through the outflow hole 330 together.

In addition, the inflow hole 320 and the outflow hole 330 are located in opposite sides of the partition wall 340, respectively. Therefore, a duct path is formed to have 90 degrees or more with regard to a horizontal plane. In other words, since the inflow hole 320 and the outflow hole 330 are formed in locations close to each other but are blocked by the partition wall 340 and the mesh member 360, the duct path is configured to travel from one side of the partition wall 340 to opposite side, thereby having a long path.

The partition wall 340 of the present invention is shaped to block a duct path in a vertical direction inside the duct space 310, but may be formed as a horizontal shape in a portion where the mesh member 360 is installed for installment convenience and securing installment area of the mesh member 360. More specifically, as illustrated in FIG. 2, the partition wall 340 comprises a lower vertical wall 341 vertically formed from a bottom of the duct space 310 to a level of a given height; an upper vertical wall 342 vertically formed from a top, or a ceiling, of the duct space 310 to the level of an extended height of the lower vertical wall 341 at a location distant from the lower vertical wall 341; and a connection wall 343 horizontally connecting between the lower vertical wall 341 and the upper vertical wall 342. The tuning hole 350 is formed in the connection wall 343, thereby enabling the mesh member 360 to be formed in a horizontal direction.

Figure 3:
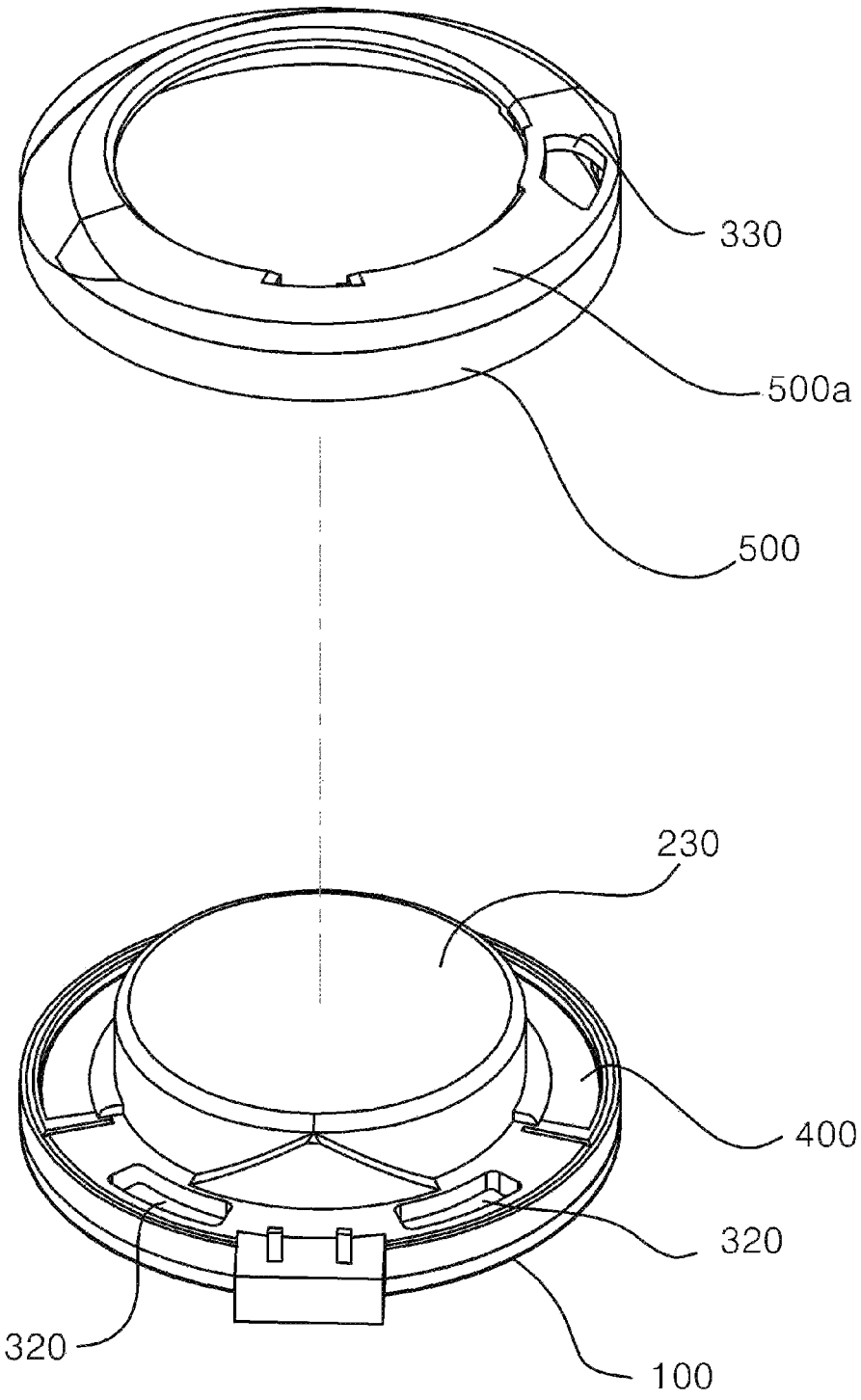
FIG. 3 is an exploded perspective view of the frame member in the first embodiment of the present invention.

As illustrated in FIG. 3, the frame member 300 according to the first embodiment comprises: a lower frame 400 surrounding circumference of the yoke 230 at a location close to the diaphragm 100 and including the inflow hole 320 formed to communicate in a vertically direction; and an upper frame 500 connected to a top portion of the lower frame 400, thereby forming the duct space 310, and including the outflow hole 330 formed at a top portion thereof and the partition wall 340 integrated therein.

The lower frame 400 has a small letter l-shape cross-section, and the upper frame 500 has a capital letter L-shape cross-section. Accordingly, a combination of the lower frame 400 and the upper frame 500 can produce the duct space 310 along circumference of yoke 230.

Figure 4:
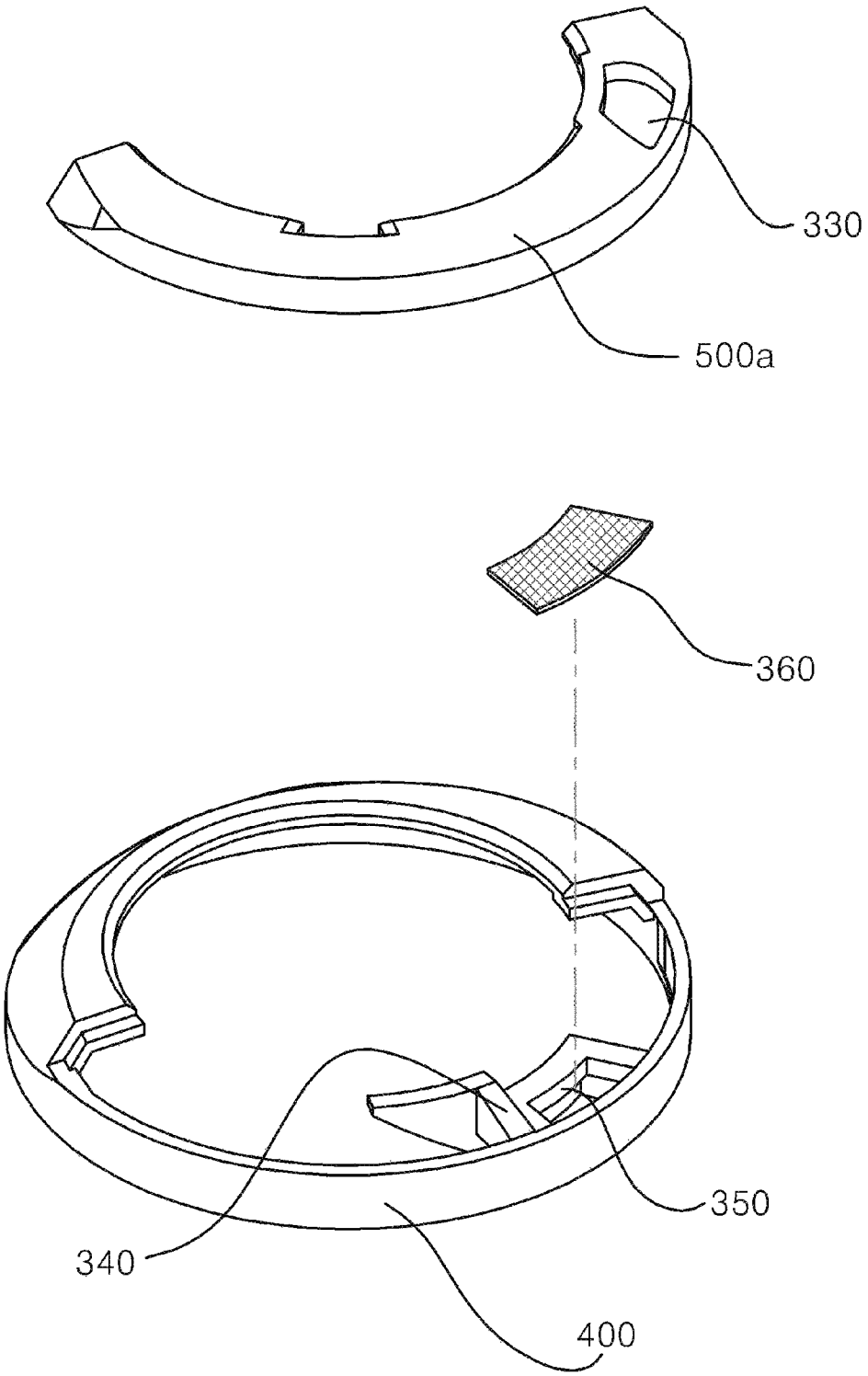
FIG. 4 is an exploded perspective view of an upper frame of the frame member in the first embodiment of the present invention.
Figure 5:
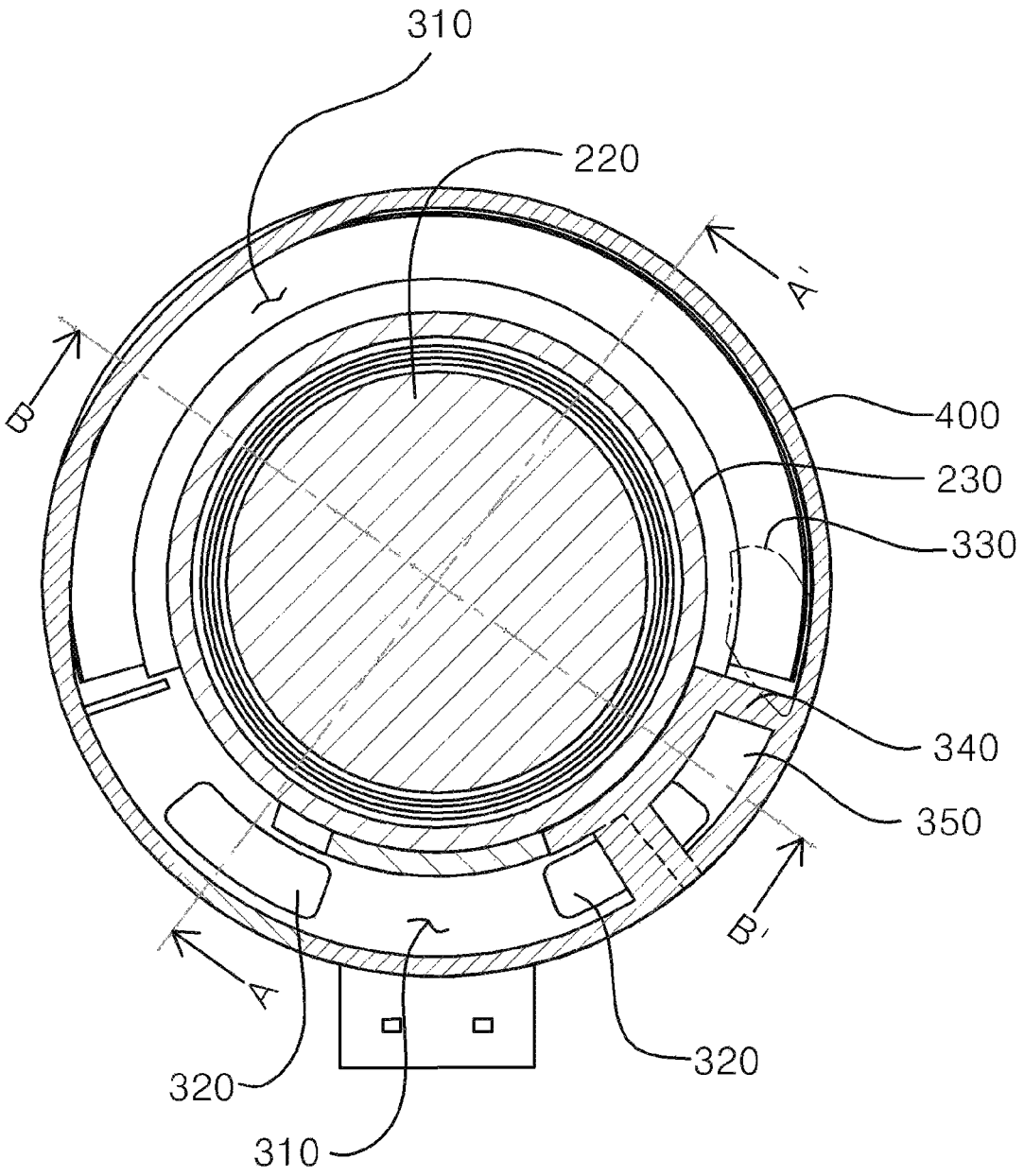
FIG. 5 is a top cross-sectional view of the duct structure in the first embodiment of the present invention.
Figure 6:
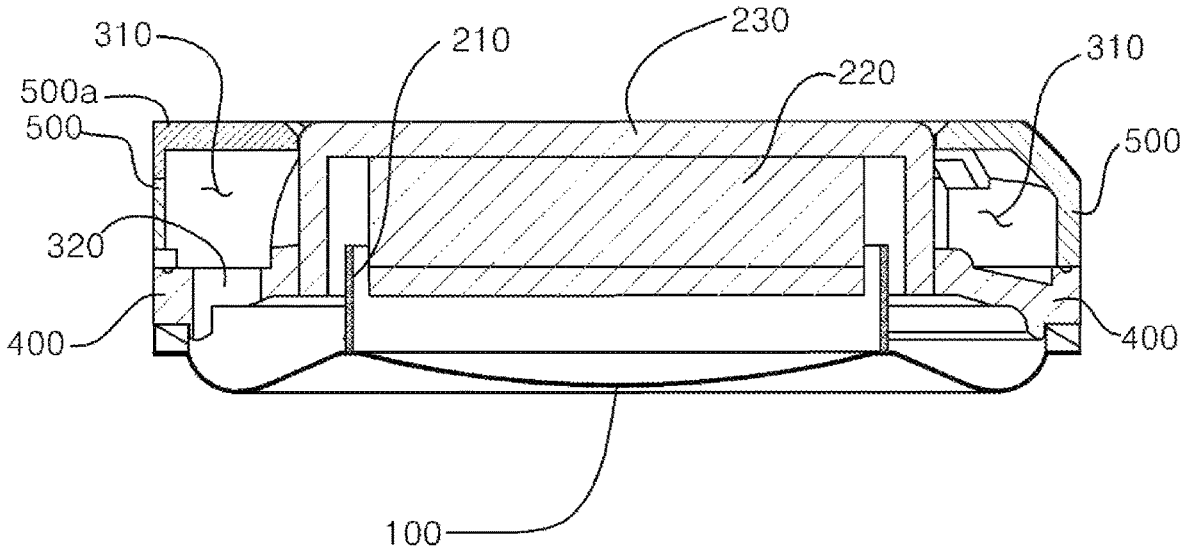
FIG. 6 is a cross-sectional view cut along A-A' line of FIG. 5.
Figure 7:
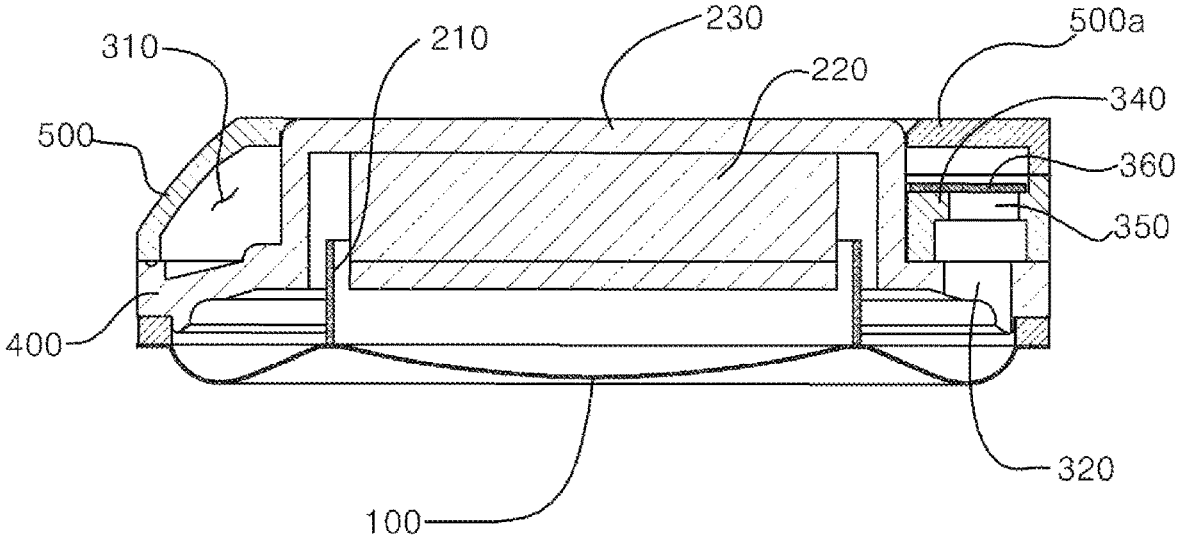
FIG. 7 is a cross-sectional view cut along B-B' line of FIG. 5.

The upper frame 500 may be a single structure, however, as illustrated in FIG. 4, it is desired to further comprise a separable installment panel 500*a* formed in a location where the mesh member 360 is installed.

Figure 8:
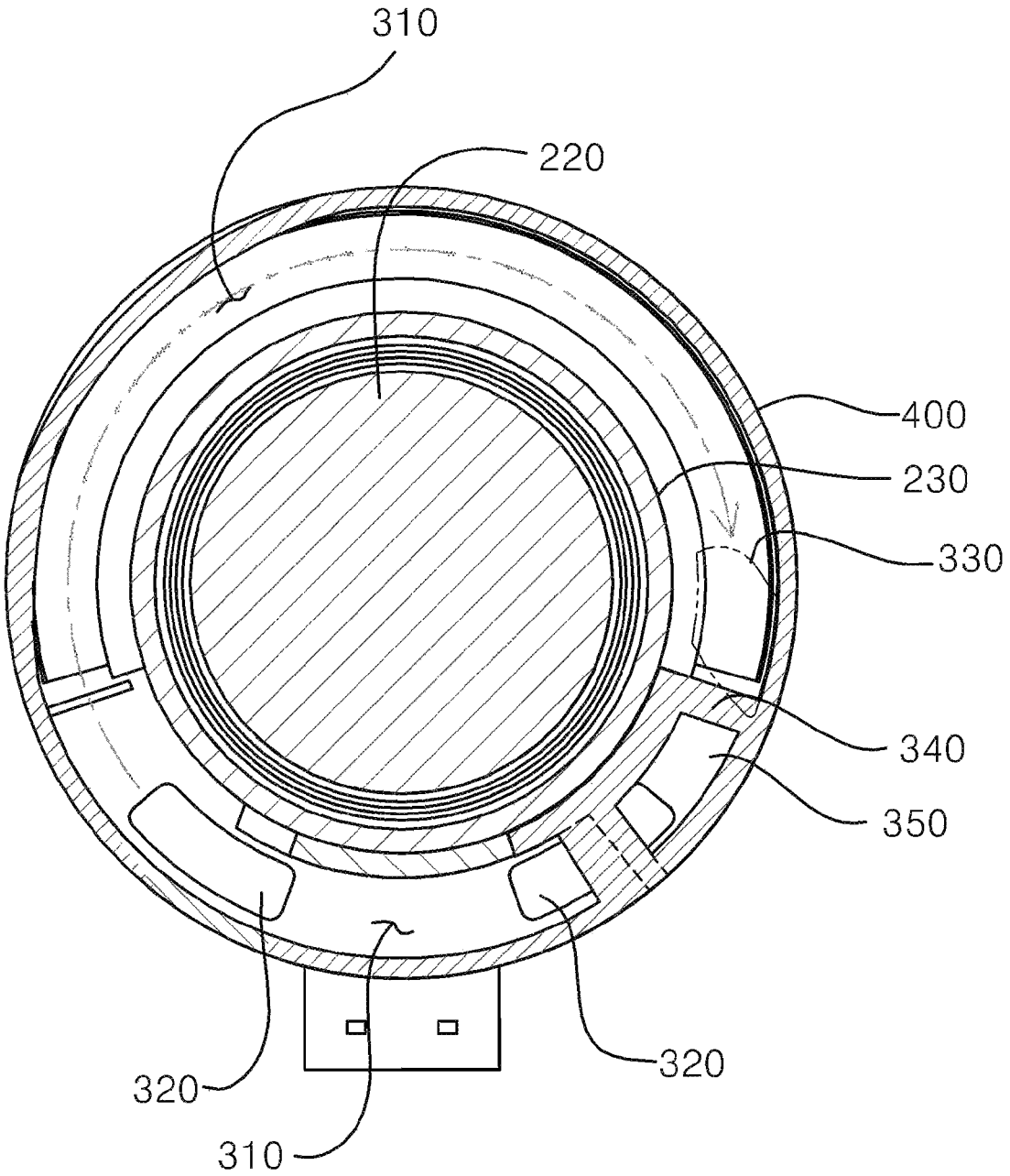
FIG. 8 is an exemplary drawing showing a duct path seen from a top view in the first embodiment of the present invention.
Figure 9:
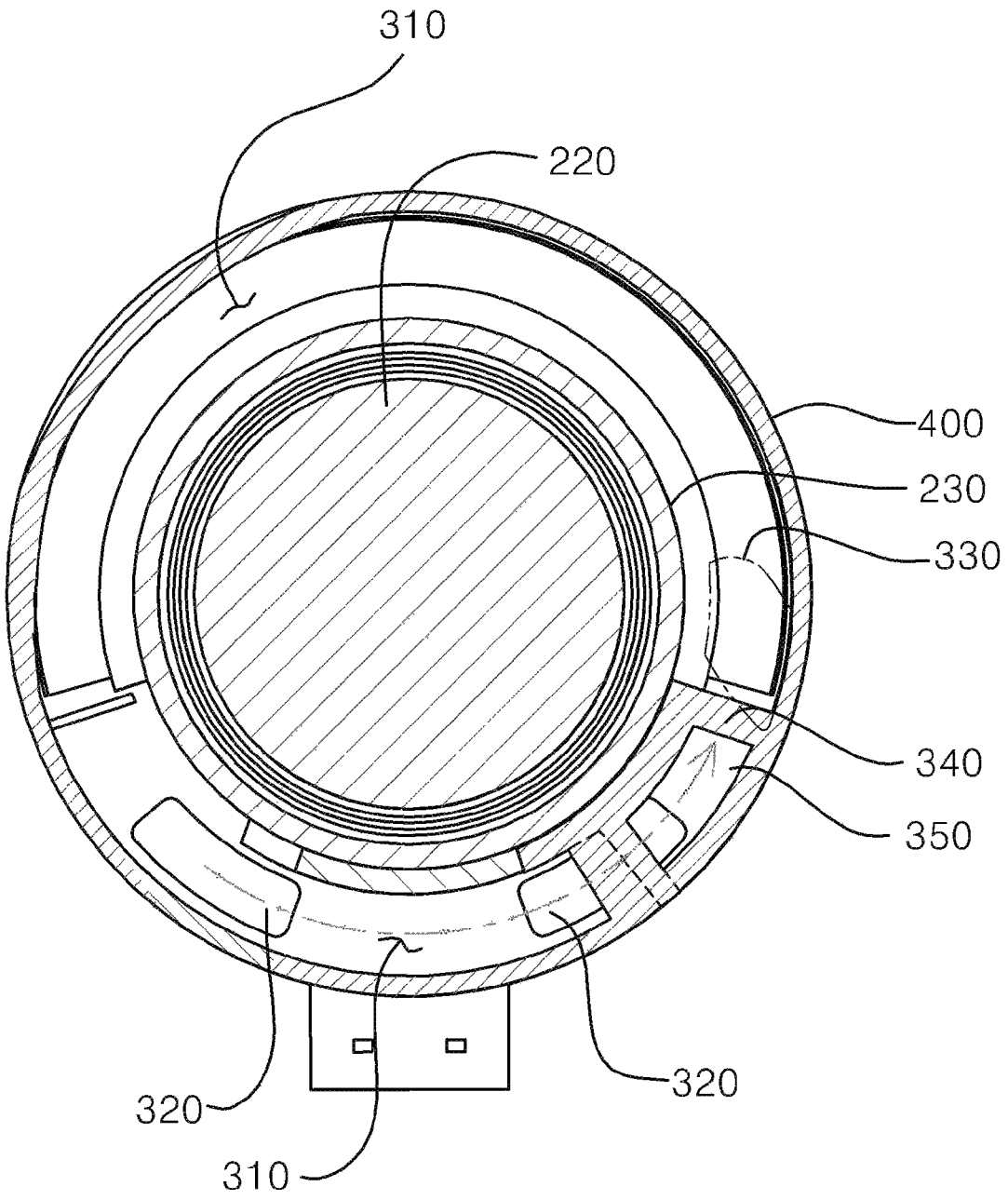
FIG. 9 is an exemplary drawing showing a tuning path seen from a top view in the first embodiment of the present invention.

As illustrated in FIG. 8, the first embodiment of the present invention enables to form a long duct path by forming a duct path traveling from the inflow hole 320 and one side of the partition wall 340 to an opposite side of the partition wall 340 and the outflow hole 330 without passing through the partition wall 340. In this instance, as illustrated in FIG. 9, a tuning path of this structure, which travels from the inflow hole 320 to the outflow hole 330 through the mesh member 360, is relatively short compared to the duct path.

Second Embodiment

Figure 10:
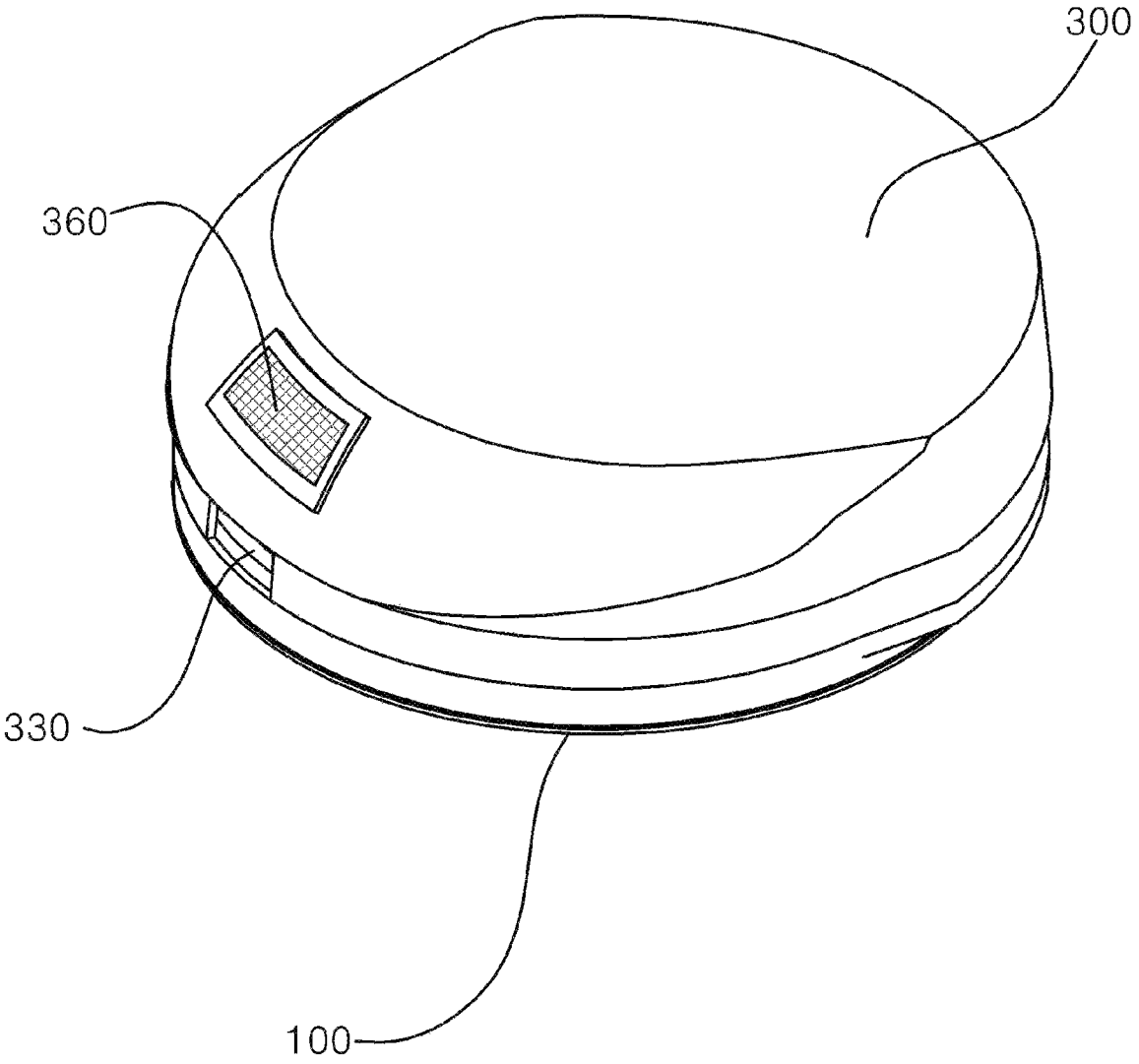
FIG. 10 is a perspective view showing a second embodiment of a duct structure of an earphone speaker unit according to the present invention.
Figure 11:
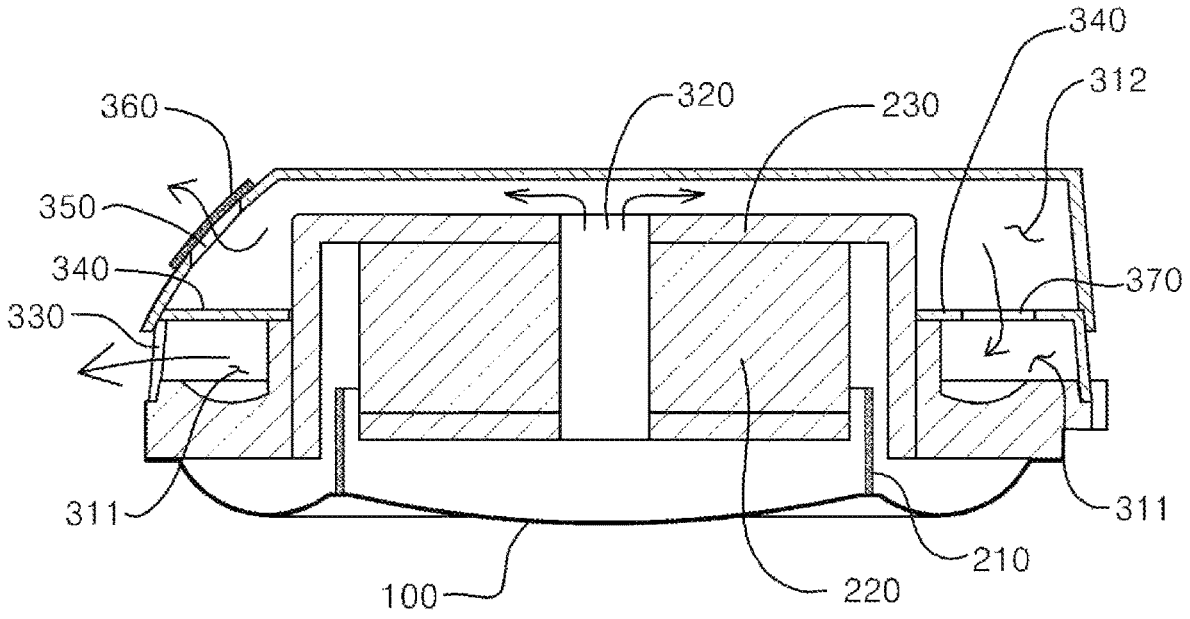
FIG. 11 is a cross-sectional view of an inner structure of a frame member in the second embodiment of the present invention.

As illustrated in FIGS. 10 and 11, a frame member 300 according to the second embodiment of the present invention forms a first duct space 311 having a donut shape along circumference of the yoke 230 and a second duct space 312 having a circle shape that is formed from a top of the partition wall 340 to a level spaced apart from a top of the yoke 230. The frame member 300 comprises an inflow hole 320 formed in a top portion of the yoke 230 so that sound generated from the speaker module 200 flows into the second duct space 312; a connection hole 370 communicating between the second duct space 312 and the first duct space 311; an outflow hole 330 formed in one side of the first duct space so that sound inside the first duct space 311 flows out to the outside; a tuning hole 350 formed in the second duct space 312 and communicating to the outside; and a mesh member 360 installed to block the tuning hole 350, thereby enabling acoustic tuning.

While in case of the first embodiment described earlier, the frame member 300 surrounds only circumference of the yoke 230 and reveals some parts of the yoke 230, in case of the second embodiment, a frame member 300 surrounds an entire outer surface of the yoke 230, and the yoke 230 is not revealed to the outside.

According to the second embodiment, the first duct space 311 is formed inside a lower portion of the frame member 300, and the second duct space 312 is formed inside an upper portion of the frame member 300. Accordingly, the present invention provides a dual-type duct structure that is partitioned into an upper space and a lower space. In this instance, the second duct space 312 is a space for acoustic tuning, and the first duct space 311 is a space for sound outflow.

As illustrated in FIG. 11, the inflow hole 320 of the second embodiment is formed in the top portion of the yoke 230, and sound generated from the speaker module 200 flows into the second duct space 312 first. In other words, sound flowing into the second duct space 312 through the inflow hole 320 is acoustically tuned through the tuning hole 350 and the mesh member 360 formed in the second duct space 312. Then, sound is transferred to the first duct space 311 through the connection hole 370 of the partition wall 340 and flows out to the outside through the outflow hole 330 formed in the first duct space 311.

In this instance, the outflow hole 330 and the tuning hole 350 are formed in a same direction with regard to a center of the duct structure as seen from a top view. The tuning hole 350 is located above the outflow hole 330 as seen from a side view. Meanwhile, the connection hole 370 is formed at a location in an opposite direction to the direction of the outflow hole 330 and the tuning hole 350 with regard to a center of the duct structure as seen from a top view. In this instance, the tuning hole 350 and the connection hole 370 are located farthest from each other, and the outflow hole 330 and the connection hole 370 are also located farthest from each other. Accordingly, the present invention enables to secure the tuning path and the duct path within a limited space.

Figure 12:
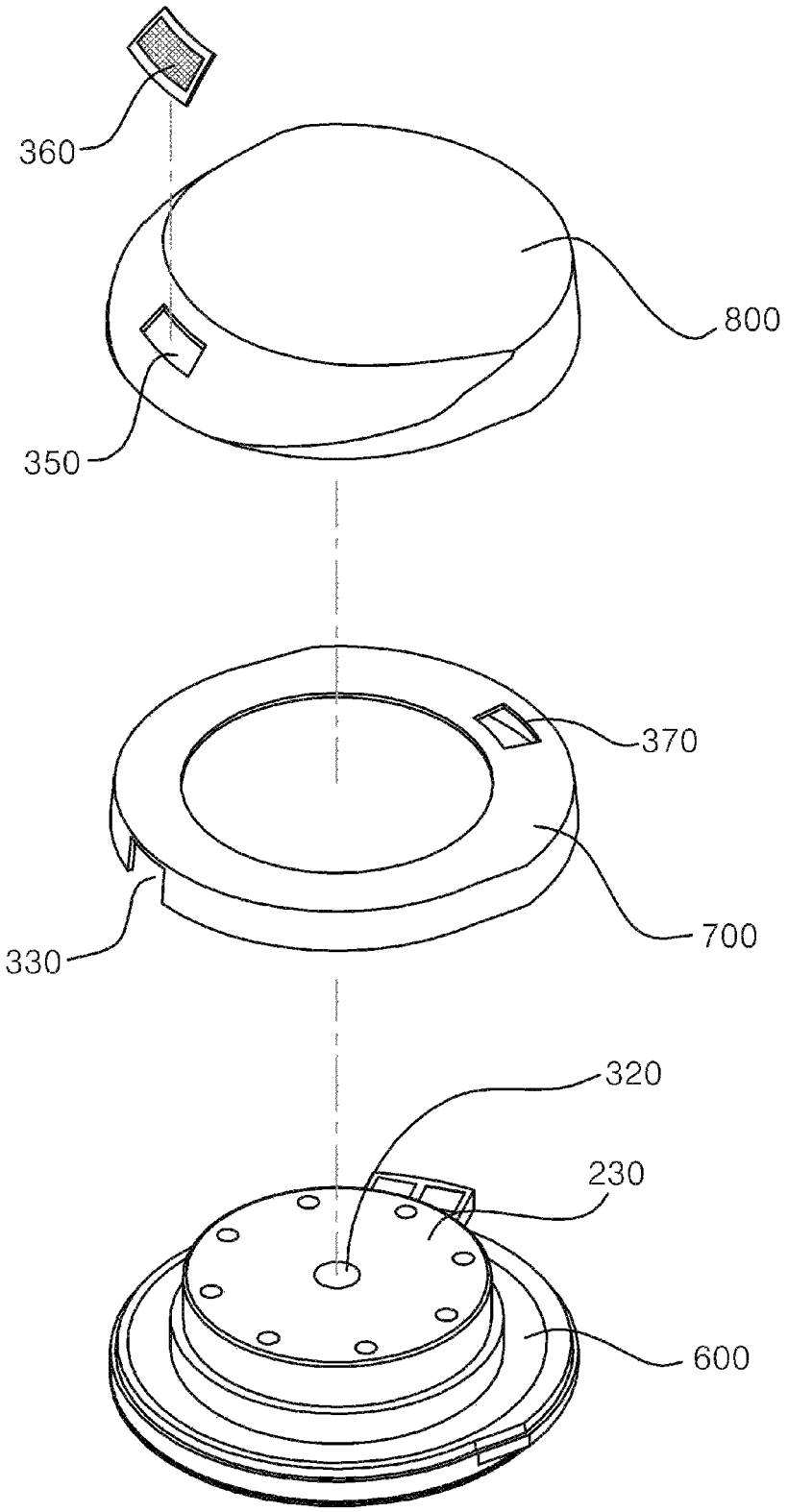
FIG. 12 is an exploded perspective view of the frame member in the second embodiment of the present invention.

As illustrated in FIG. 12, the frame member 300 of the second embodiment comprises: a first frame 600 surrounding circumference of the yoke 230; a second frame 700 connected to a top portion of the first frame 600, forming a first duct space 311 along circumference of the yoke 230 with a capital letter L-shape cross-section, and including the outflow hole 330 formed in an edge portion thereof and the connection hole 370 formed in a top portion thereof; and a third frame 800 connected to a top portion of the second frame 700 and forming a second duct space 312, which is formed to a level spaced apart from a top end of the yoke 230 and is larger than the first duct space 311, and including an outflow hole 350 formed a top portion thereof.

The first and the second embodiment are configured to form a tuning path distinguished from a duct path inside the duct space of the frame member and thereby enables an acoustic tuning property to be improved.

Figure 13:
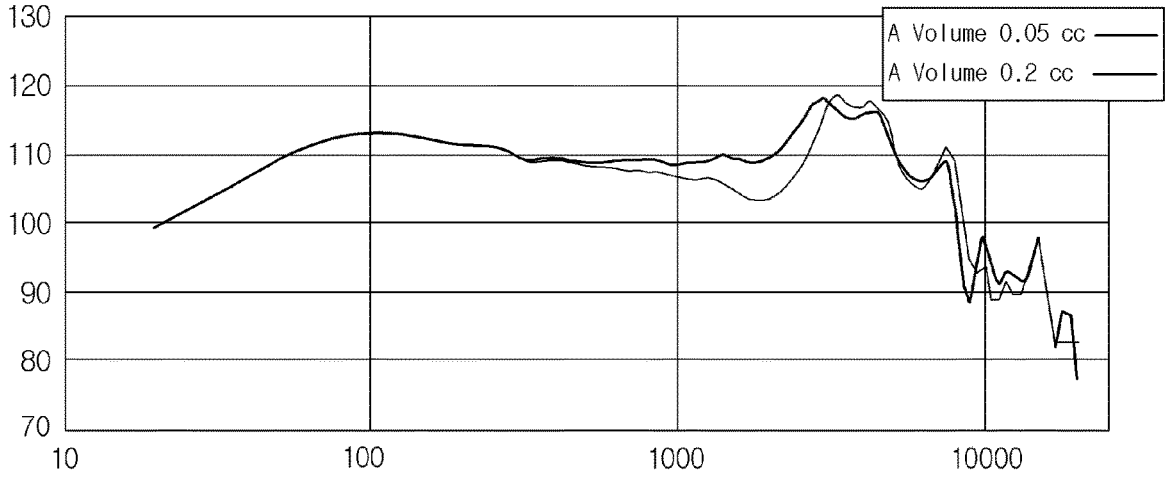
FIG. 13 is a graph showing a relation between A volume and a duct path.
Figure 14:
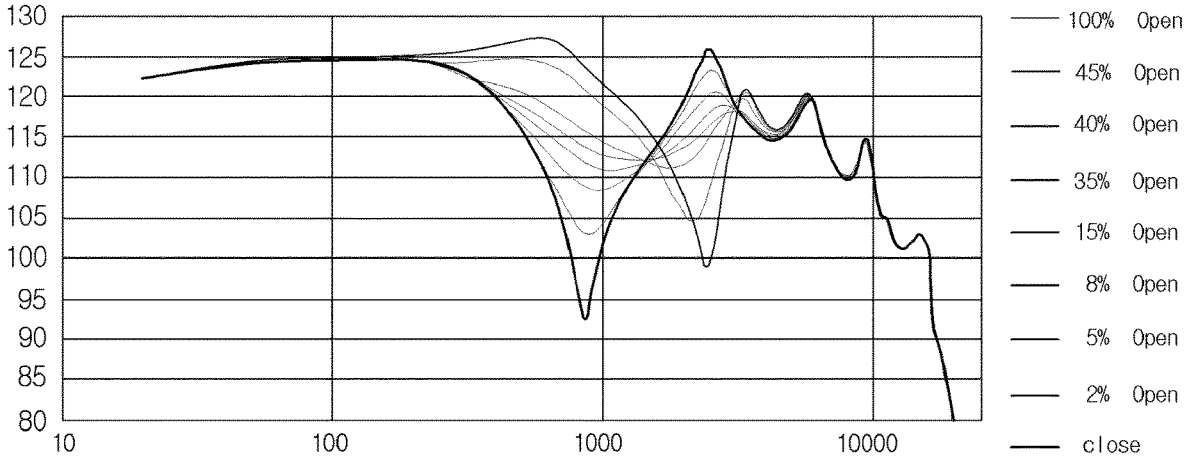
FIG. 14 is a graph showing a relation a hole area of a mesh member and tuning of middle frequency range sound.

As illustrated in FIG. 13 and FIG. 14, a resonance tuning property of middle frequency range sound is improved according to an existence of A volume ("A volume" refers to a space of the tuning path) and a size of A volume. In addition, since as an opening area of the mesh member installed inside A volume is smaller, sound pressure increases, and as the opening area is bigger, sound pressure decreases, the structure of the present invention enables middle frequency range sound to be tuned.

Figure 15:
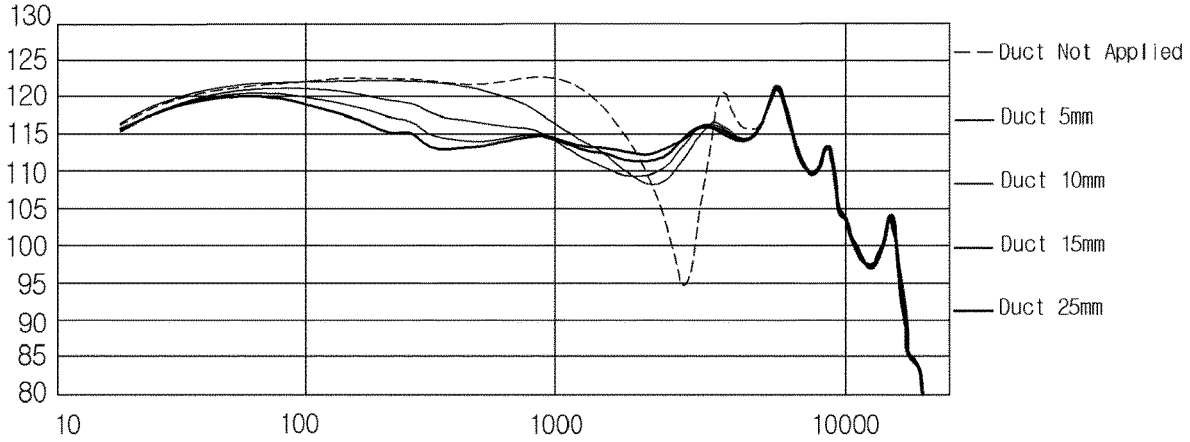
FIG. 15 is a graph showing resonance of middle frequency range sound that is adjusted according to a length.
Figure 16:
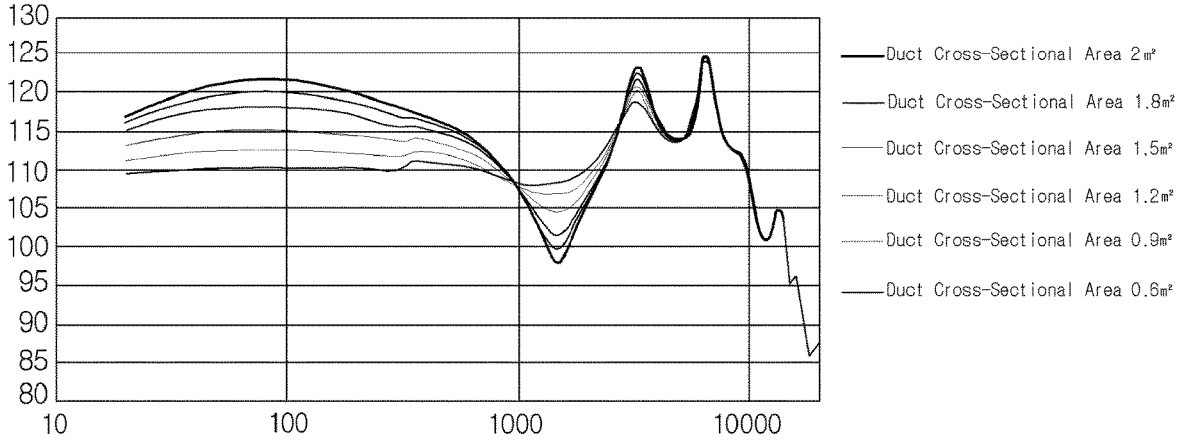
FIG. 16 is a graph showing sound pressure properties a cross-sectional area of the duct path.

In addition, as illustrated in FIG. 15 and FIG. 16, as a length of the duct is longer, resonance of low frequency range sound is shifted to be much lower frequency range sound. In addition, sound pressure is adjusted according to a cross-sectional area of the duct path. Accordingly, the present invention can be designed for proper frequency range sound and a proper level of sound pressure using resonance and sound pressure properties by adjusting the length of the duct and the cross-sectional area of the duct path.

While embodiments of the present invention have been described, the present invention is not limited to what has been particularly shown. It would be apparent that many more modifications and variations than mentioned above are possible.

What is claimed is:

1. A duct structure of an earphone speaker unit, the duct structure comprising:

a diaphragm;

a speaker module located at a back of the diaphragm, comprising an acoustic coil, a magnet, and a yoke, and generating sound of the diaphragm, and a frame member surrounding the yoke of the speaker module, wherein the frame member forms a donut-shaped duct space along circumference of the yoke, and wherein the frame member comprises:

an inflow hole formed in an outer surface thereof to enable sound generated from the speaker module to flow into the duct space of the frame member;

an outflow hole formed in an outer surface thereof to enable sound inside the duct space to flow out to the outside;

a partition wall blocking a path of sound inside the duct space;

a tuning hole formed to penetrate through the partition wall; and a mesh member installed to block the tuning hole, thereby enabling acoustic tuning, wherein a duct path is formed by forming a path traveling from the inflow hole and one side of the partition wall to an opposite side of the partition wall and the outflow hole without passing through the partition wall; and a tuning path which travels from the inflow hole to the outflow hole through the mesh member is formed, the tuning path being relatively short compared to the duct path, thereby allowing both sound passing through the duct path and sound passing through the tuning path to flow out to the outside through the outflow hole.

2. The duct structure according to claim 1, wherein the inflow hole and the outflow hole are located in opposite sides of the partition wall, respectively, and wherein the duct path from the inflow hole to the outflow hole is formed to have 90 degrees or more with regard to a circumferential direction of the duct space.

3. The duct structure according to claim 1, wherein the partition wall comprises:

a lower vertical wall vertically formed from a bottom of the duct space to a level of a given height;

an upper vertical wall vertically formed from a top of the duct space to the level of the height of the lower vertical wall at a location distant from the lower vertical wall; and a connection wall horizontally connecting between the lower vertical wall and the upper vertical wall, wherein the tuning hole is formed in the connection wall, thereby enabling the mesh member to be formed in a horizontal direction.

4. The duct structure according to claim 1, wherein the frame member comprises:

a lower frame surrounding circumference of the yoke at a location close to the diaphragm and including the inflow hole formed to communicate in a vertical direction; and an upper frame that is connected to a top portion of the lower frame, thereby forming the duct space and that includes the outflow hole formed at a top portion thereof and the partition wall integrated thereto.

5. A duct structure of an earphone speaker unit, the duct structure comprising:

a diaphragm;

a speaker module located at a back of the diaphragm, comprising an acoustic coil, a magnet, and a yoke, and generating sound of the diaphragm, and a frame member surrounding the yoke of the speaker module, wherein the frame member forms:

a first duct space having a donut shape along circumference of the yoke, and a second duct space having a circle shape and formed from a top of a partition wall to a level spaced apart from the yoke, the partition wall dividing the first duct space and the second duct space;

wherein the frame member comprises:

an inflow hole formed in a top portion of the yoke to enable sound generated from the speaker module to flow into the second duct space;

a connection hole communicating between the second duct space and the first duct space;

an outflow hole formed in one side of the first duct space to enable sound inside the first duct space to flow out to the outside;

a tuning hole formed in the second duct space and communicating to the outside; and a mesh member installed to block the tuning hole, thereby enabling acoustic tuning, wherein the frame member further comprises:

a first frame surrounding circumference of the yoke;

a second frame connected to a top portion of the first frame, forming the first duct space along circumference of the yoke with a L-shape cross-section thereof, and including the outflow hole formed in an edge portion thereof and the connection hole formed in a top portion thereof; and a third frame that is connected to a top portion of the second frame; that forms the second duct space that is formed to a level spaced apart from a top of the yoke and that is larger than the first duct space; and that includes the outflow hole formed in a top portion thereof.

6. The duct structure according to claim 5, wherein the outflow hole and the tuning hole are formed in a same direction with regard to a center of the duct structure as seen from a top view, and the tuning hole is located above the outflow hole, wherein the connection hole is formed at a location in an opposite direction to the direction of the outflow hole and the tuning hole with regard to a center of the duct structure as seen from a top view.

* * * * *